US007045058B2

(12) United States Patent
Walczyk

(10) Patent No.: US 7,045,058 B2
(45) Date of Patent: May 16, 2006

(54) TRASH COLLECTION SKIMMER BOAT

(75) Inventor: Stephen L. Walczyk, Weedsport, NY (US)

(73) Assignee: Barber Welding, Inc., Weedsport, NY (US)

( * ) Notice: Subject to any disclaimer, the term of this patent is extended or adjusted under 35 U.S.C. 154(b) by 96 days.

(21) Appl. No.: 10/949,865

(22) Filed: Sep. 24, 2004

(65) Prior Publication Data

US 2006/0065586 A1 Mar. 30, 2006

(51) Int. Cl.
*C02F 1/40* (2006.01)

(52) U.S. Cl. ..... 210/170; 210/242.1; 210/239

(58) Field of Classification Search ..... 210/170, 210/236, 239, 260, 242.1, 242.3, 776, 923
See application file for complete search history.

(56) References Cited

U.S. PATENT DOCUMENTS

| | | | | | |
|---|---|---|---|---|---|
| 3,268,081 | A | | 8/1966 | Menkee et al. | 210/242 |
| 3,539,048 | A | | 11/1970 | Pearson | 210/242 |
| 3,700,108 | A | * | 10/1972 | Richards | 210/242.3 |
| 3,704,784 | A | | 12/1972 | Craggs et al. | 210/242 |
| 3,730,119 | A | | 5/1973 | Budris et al. | 114/0.5 R |
| 3,966,613 | A | | 6/1976 | Kirk et al. | 210/242 |
| 3,968,041 | A | * | 7/1976 | De Voss | 210/242.3 |
| 4,322,294 | A | | 3/1982 | Price | 210/242.3 |
| 4,363,735 | A | * | 12/1982 | Hook | 210/242.1 |
| 5,028,325 | A | | 7/1991 | Hamilton | 210/242.1 |
| 5,173,182 | A | | 12/1992 | Debellian | 210/170 |
| 5,207,901 | A | * | 5/1993 | Ravagnan | 210/242.1 |
| 5,362,391 | A | * | 11/1994 | Stephens | 210/242.3 |
| 5,456,197 | A | | 10/1995 | Kwok | 114/56 |
| 5,753,108 | A | * | 5/1998 | Haynes et al. | 210/170 |
| 6,328,165 | B1 | * | 12/2001 | Baker et al. | 209/235 |
| 6,669,841 | B1 | | 12/2003 | Morin | 210/170 |
| 2001/0020434 | A1 | | 9/2001 | Thomas | 114/26 |

FOREIGN PATENT DOCUMENTS

| | | |
|---|---|---|
| JP | 2092797 | 4/1990 |

* cited by examiner

*Primary Examiner*—Christopher Upton
(74) *Attorney, Agent, or Firm*—Bernhard P. Molldrem, Jr.

(57) ABSTRACT

A trash skimmer work boat collects and discharges debris from the front or bow. A storage conveyor positioned approximately amidships and along the center line, and is mounted to the hull on a slide or track arrangement that permits fore and aft motion. A collection and discharge conveyor is mounted at the bow portion of the hull. The forward conveyor can be oriented in a trash collection position or in a trash discharge position. The storage conveyor is brought sternward so that there is clearance for the proximal end of the forward conveyor to be raised or lowered, and then is brought back forward so that the storage conveyor is in position to receive debris or to discharge it. Auxiliary floats at the sides of the boat hull provide additional buoyant support for the front conveyor, and are detachable so they can be removed for road transport of the boat.

12 Claims, 4 Drawing Sheets

TRASH COLLECTION SKIMMER BOAT

BACKGROUND OF THE INVENTION

This invention relates to skimmer boats, i.e., work boats for collecting and disposing of floating solid waste materials in harbors and waterways. The invention is more specifically directed to highly maneuverable vessels equipped with means for picking up floating debris, means for storing the debris on the vessel, and means for discharging the debris from the vessel to a storage area, which may be ashore or which may be another vessel such as a barge.

Many work boats and vessels have been proposed for collection of floating solid waste and other debris. These may typically be formed as a catamaran-type hull, i.e., a pair of pontoons or sponsons, or as a monohull, with paddle wheel or screw drive propulsion, and an operator station. In one typical trash skimmer design, one or more hydraulically powered open mesh conveyors are positioned between the pontoons of a catamaran-type twin-hull vessel. Twin over-the-rear propellers are used to propel and maneuver the vessel, and these can be tipped up for cleaning weeds and debris from the propeller blades. A main pickup conveyor extends off the front end, and extends into the water to catch the floatables, which it picks up and carries back to a main storage conveyor. When the storage conveyor is completely loaded, the boat is taken to a discharge position where the debris can be transferred to a truck or barge or other facility. A rear conveyor at the stern of the craft carries the debris from the storage conveyor up and back to drop it into the barge or on-shore storage facility. In some cases, a separate, on-shore conveyor can be used to pick up the trash discharged from the vessel.

In the vessels of this type, the debris or trash is picked up and loaded from the front, and is discharged from the rear or stern of the vessel. This means that there have to be three conveyor system, i.e., a pick-up or loading conveyor, a storage conveyor, and a discharge or unload conveyor. Second, because the region of the vessel on the centerline and sternward of the storage conveyor is occupied by the discharge conveyor, the motor, the cockpit or operator control position, and any other necessary equipment have to located to one side or the other, usually atop one of the pontoons. The control position may be located on a bridge standing over the storage area.

A number of skimmer boats of various designs for collection of floating solid debris have been proposed, for example, in U.S. Pat. No. 6,669,841 to Morin, U.S. Pat. No. 5,173,182 to Debellian, U.S. Pat. No. 5,028,325 to Hamilton, and U.S. Pat. No. 3,730,119 to Budris et al.

At present, there are no skimmer boats designed for loading and discharge from the same end using the same conveyor. Also, there are no work boats in which an auxiliary portion of the hull can be added for extra flotation for the forward conveyor, and can be removed to keep the vessel narrow enough to be trucked or trailered on a roadway.

OBJECTS AND SUMMARY OF THE INVENTION

Accordingly, it is an object of the invention to provide an effective and efficient work boat for clean up of debris or trash from harbors, waterways, or other bodies of water, and which avoids the drawbacks of the prior art.

It is another object to provide a trash skimmer of improved design to facilitate loading of trash onto the vessel and discharge of trash from the vessel.

It is a further object to provide a trash skimmer vessel that is stable and easily maneuverable in the water, simple to operate for collection and discharge operations, and is easily trailerable for transportation by roadway between work sites.

According to one aspect of this invention, a trash collection skimmer boat is designed for collecting trash in a harbor, canal, lakeshore, or other body of water and later discharging the collected trash to a discharge station, i.e., truck or barge. The skimmer's flotation hull can favorably be of an open design, in which there are left and right (i.e., port and starboard) hull portions or pontoons, such that the hull has a bow or forward end and a stern or rear end. A storage conveyor positioned on the boat hull, favorably approximately amidships and along the center line. In a favorable embodiment, the storage conveyor has an open mesh web that travels over forward and aft rollers that define forward and aft ends of the storage conveyor. The storage conveyor is mounted to the hull on a slide or track arrangement that permits motion fore and aft for a limited distance relative to the hull. An actuator, i.e., a linear motor, moves the storage conveyor controllably in the fore and aft direction between its limits of travel.

A forward conveyor is mounted at the bow portion of the hull and is used for picking up trash or debris from the body of water and transferring the same to the storage conveyor. The forward conveyor is also used discharging the trash or material stored on the skimmer boat to a discharge station. A frame of the forward conveyor extends past the bow of the trash skimmer. The frame is mounted to the hull so that it can be tilted at a range of angles, up and down, and so that the proximal end of the forward conveyor can be positioned above or below the distal or forward end of the storage conveyor. The forward conveyor favorably has an open mesh web, and fore and aft rollers over which the web travels and defining distal and proximal ends of the forward conveyor.

The forward conveyor can be oriented by the operator, such that in a trash collection position the proximal end of the forward conveyor is positioned above the forward end of the storage conveyor, and in a trash discharge position the proximal end of the forward conveyor is positioned below the forward end of the storage conveyor. The storage conveyor is brought sternward so that there is clearance for the proximal end of the forward conveyor to be raised or lowered, and then is brought back forward so that the storage conveyor is in position to receive the trash and debris from the forward conveyor or to discharge the trash and debris onto it.

At the front or distal end of the forward conveyor there are preferably also a pair of supplemental conveyors. These are respectively carried on left and right jaw members or wings. These jaw members are articulated so that they can open and close laterally. This enables the front conveyor to pick up debris from a wide area at the front of the vessel. The jaws can be narrowed when loading from a narrow area, i.e., between slips in a harbor, for discharge, or for transport.

The engine for the vessel, which also powers the conveyors and the actuator, is mounted on the hull, favorably sternward of said storage conveyor and on the centerline. In one favorable embodiment, a stern hull portion is situated beneath the engine, such that the port and starboard pontoon members extend forward from the sides of the stern hull portion. This hull portion at the stern end provides plenty of buoyancy at the position of the engine. Favorably, the hydraulic pump and associated equipment are located adjacent the engine, and the hydraulic reservoir and valving are preferably located between the engine and a stern wall of the storage conveyor.

A pair of demountable auxiliary floats or sponsons are mounted outward of main hull on the port and starboard sides to provide additional floatation for the front conveyor when the boat is in the water. These auxiliary floats are removed from the hull when the boat is out of the water and needs to be transported by truck or trailer. Removal of these auxiliary floats permits the boat to be made as wide as possible. With the additional floatation removed, the rest of the boat hull is within legal width limits for road transport.

Propulsion and maneuvering are achieved with a pair of screw drives, each positioned at the stern of the vessel at port and starboard sides, with each screw drive having a respective hydraulic motor for powering it. Each screw drive is mounted on a respective elevator at the stern of the boat that permits vertical position of the drive to be adjusted to control the depth of the screw or propeller. Each elevator has an associated hydraulic cylinder or actuator. A control deck is supported on the hull and is elevated above the storage conveyor. The operator is positioned on the control deck and has access to hydraulic controls for the boat's functions.

The above and many other objects, features, and advantages of this invention will become apparent to persons skilled in the art from the ensuing description of a preferred embodiment, which should be considered in connection with the accompanying Drawing.

DETAILED DESCRIPTION OF A PREFERRED EMBODIMENT

Figure 1:
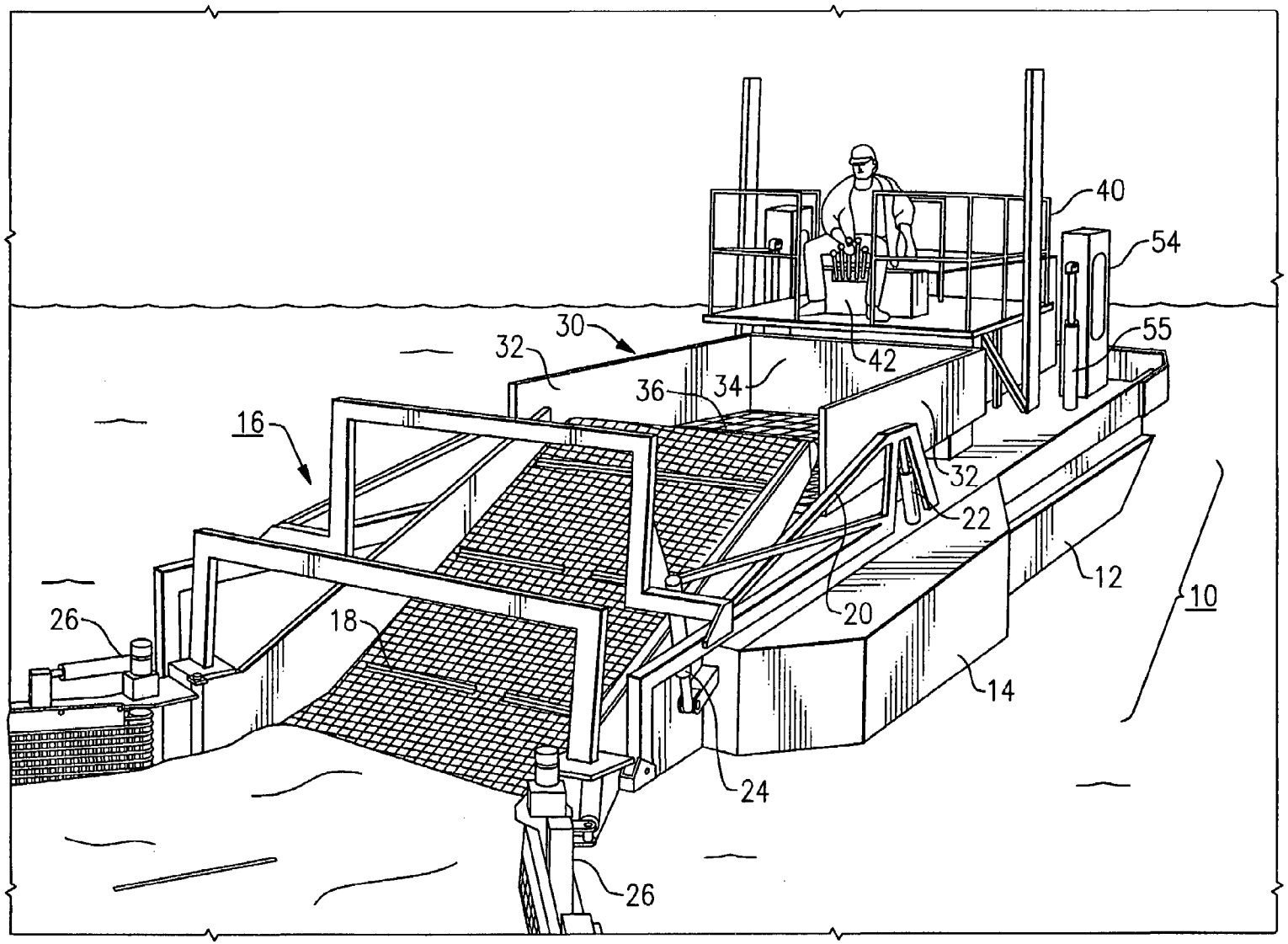
FIG. 1 is a perspective view of a trash skimmer boat according to one embodiment of the present invention.

With reference to the Drawing, and initially to FIG. 1 thereof, a perspective view of the trash skimmer boat or watercraft 10 has a catamaran-type hull with a pair of elongated hull elements 12, i.e., floats or pontoons that extend in the fore-and-aft direction and define an open space between them. One hull element 12 is on the right or starboard side and the other is on the left or port side. Each hull element 12 has an associated auxiliary float 14 which will be discussed later. The auxiliary floats 14 provides additional floatation at the front end or bow of the boat, and can be removed when the boat is trailerized for road transport.

A forward conveyor 16 extends from the bow end of the skimmer boat 10. This conveyor 16 is reversible, and is used both for collecting floating trash and also for discharging the trash onto an onshore receptacle. The conveyor 16 has a continuous mesh web 18 that travels over transverse rollers that are supported on a frame 20, with the conveyor having a distal or forward end and a proximal or aft end. The frame 20 is mounted on the hull such that the conveyor can be tilted as desired between a depressed orientation with the forward end in the water and an elevated position with the forward end raised upwards. The proximal or aft end of the conveyor 16 can be raised or lowered also. There are hydraulic actuators 22 and 24 at each side of the frame 20 for moving the forward conveyor 16 between its depressed and elevated orientations and for raising and lowering the aft end of the conveyor. In this embodiment, the front conveyor also has a pair of wings or jaws 26, each with its own mesh conveyor. These jaws 26 are articulated to open and close laterally, so that they can be spread or narrowed, as desired. In FIG. 1, the front conveyor 16 is shown inclined downwards into the water for collecting floating articles, and with the jaws 26 spread outward somewhat so as to be able to collect floating trash over a wide area. There are hydraulically powered motors (not shown) for moving the front conveyor web and those of the two jaws or wings.

Behind the forward conveyor, and located approximately amidships and at the centerline between the hull elements or pontoons 12, is a storage conveyor 30, which is intended to receive the items that are picked up by the forward conveyor 16 until they can be discharged into a waste receptacle. The storage conveyor has right and left side walls 32 and a rear or aft wall 34, and an open front. A mesh web 36 is supported horizontally to travel over transverse rollers between the open front and the aft wall 34. There are hydraulically powered motors for moving the storage conveyor web 36. The mesh web 36 of this conveyor 30 does not move continuously, but is indexed back as the solid waste accumulates onto it. The conveyor 30 is supported by means of a slide 38 to permit limited fore-and-aft motion of the conveyor 30 relative to the hull 12, and also relative to the front conveyor 16. Preferably, there is about twenty-four inches of between fore and aft limits of motion for the storage conveyor 30. Normally, when the storage conveyor 30 is in its forward position, there is an overlap of about sixteen to eighteen inches of the proximal end of the forward conveyor (roller 28 in FIG. 2) and the forward end of the storage conveyor 30. When the storage conveyor is moved to its aft position, there is a clearance of about six to eight inches between the front of the storage conveyor and the aft end of the forward conveyor. In this embodiment, a hydraulic cylinder 44 or linear motor is positioned on the boat towards the stern and has its rod end coupled with the storage conveyor to move it along the slide 38 between its forward and aft positions.

A control deck 40 or operator station is supported at an elevated position above the boat hull elements 12, and over the aft wall 34 and an aft portion of the storage conveyor 30. An operator position 42 is located here, with various hydraulic control levers so that the operator can control motion and orientation of the various conveyors, and also control the propulsion and steering of the vessel. As perhaps better shown in the side views of FIGS. 2 to 4, the rear view of FIG. 5 and the partial elevation of FIG. 6, a motor 46, e.g., a diesel engine, is situated at the aft end of the vessel 10, behind the storage conveyor back wall 34. This powers the hydraulic pump or pumps for operating the boat. An associated hydraulic tank or reservoir 48, as well as the hydraulic control valves, can be located just ahead of the motor.

Figure 5:
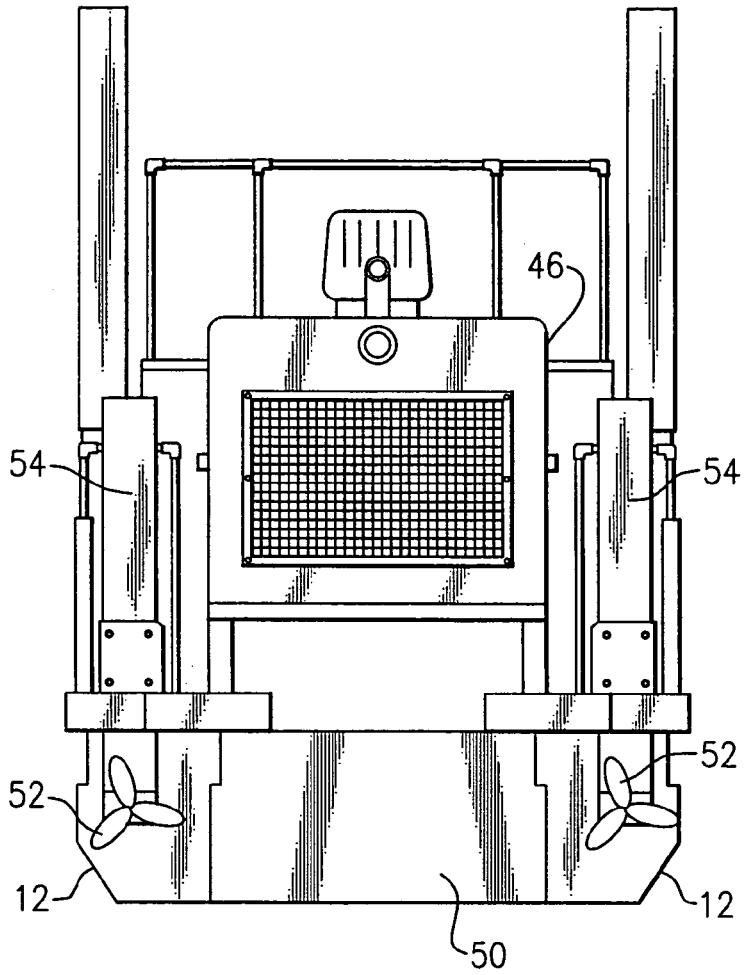
FIG. 5 is a rear view of the trash skimmer of this embodiment.
Figure 6:
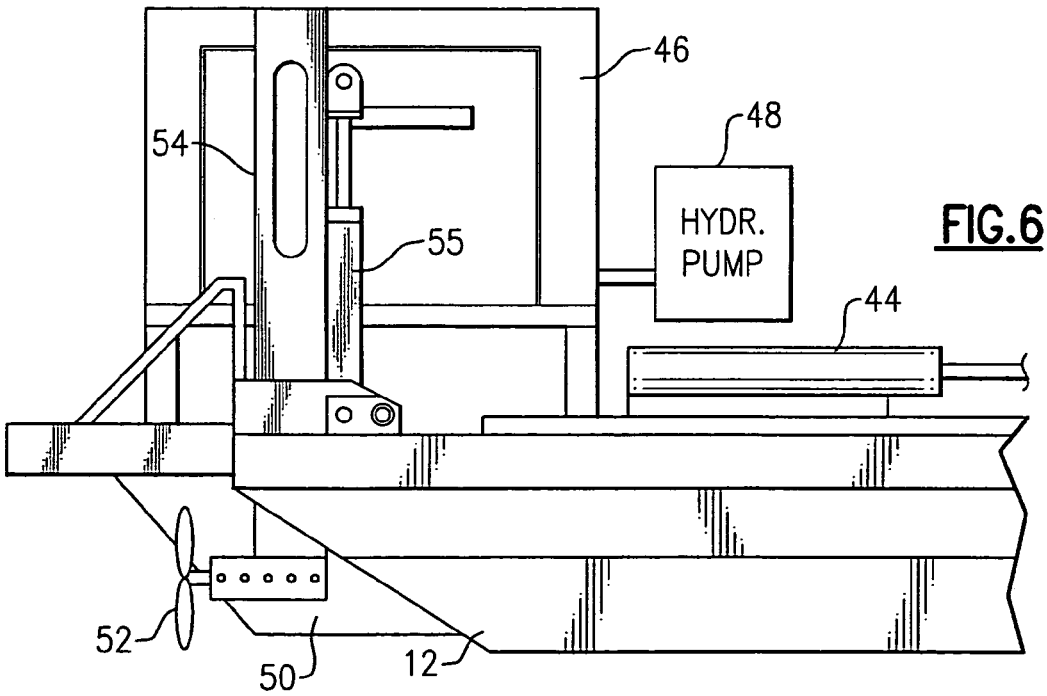
FIG. 6 shows the starboard side of the rear or aft portion of the trash skimmer of this embodiment.

As shown in FIGS. 5 and 6, the motor 46 is favorably positioned at the centerline of the boat 10, i.e., at the stern and centered between the port and starboard sides. A stern hull portion 50 is located beneath the motor position, and between the port and starboard pontoons of hull portions 12. This hull portion 50 displaces additional water at the position of the engine or motor, and helps support the boat by supplying additional flotation at the stern.

There are also left and right hydraulic drive screws 52, 52 positioned at the stern end of the port and starboard hull portions 12. Each of these is fitted into a vertical elevator 54 which can be raised and lowered by means of an associated hydraulic cylinder 55. The vertical positions of the drive screws can be independently controlled from the operator position, as can the speed and direction of rotation of each of the drive screws 52. With this arrangement, the depth of each of the drive screws can be adjusted over a range so the boat 10 can be operated in shallow or deep water. The screws can also be raised for removal of weeds and debris from the propeller, or for transport.

Figure 2:
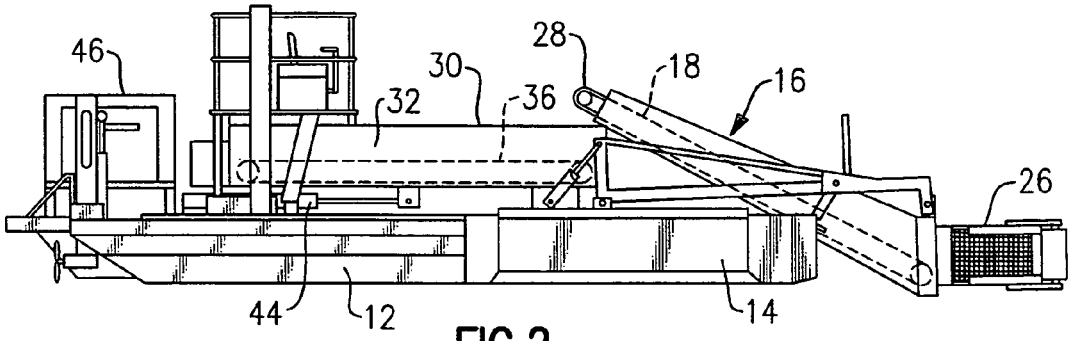
FIG. 2 is a side elevation thereof showing the trash skimmer with its front conveyor in a lowered or pick-up position.

For normal trash collection operation, the forward conveyor 16 is tilted down into the water, and the storage conveyor 30 is in its forward position, as shown in FIG. 2. Here, the proximal or aft end of the forward conveyor 16, i.e., the position of the roller 28, is positioned above the storage conveyor 30, and overlapping the forward portion of the storage conveyor. In this position, the solid matter is collected from the water and carried up the conveyor 16 to be deposited into the storage conveyor 30. The storage conveyor web can be indexed back as it begins to fill with the debris. When the boat has collected a fill of solid waste matter, the operator can drive it to a disposal site or receptacle ashore or a floating receptacle (e.g., barge).

Figure 3:
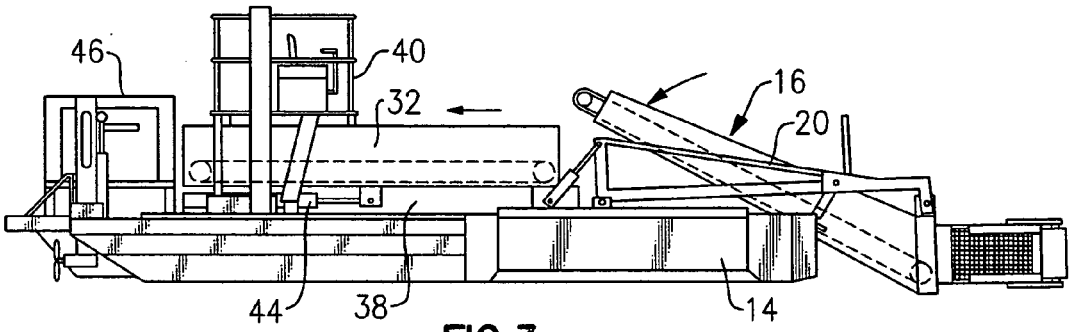
FIG. 3 is side elevation thereof showing the center conveyor retracted for moving the front conveyor to an elevated or discharge position.
Figure 4:
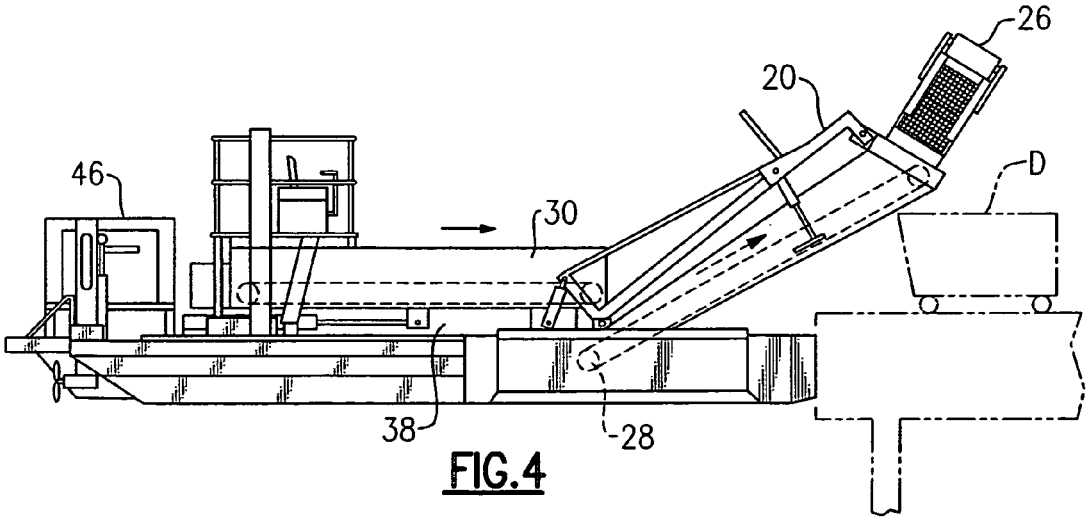
FIG. 4 is a side elevation thereof showing the front conveyor in the elevated or discharge position.

In order to discharge the trash from the boat 10, the forward conveyor has to be re-oriented so that its distal end is in its elevated position and its proximal end is located beneath the storage conveyor 30. In order to do this, the cylinder 44 is actuated to retract the conveyor 30 along the slide 38, as shown in FIG. 3. This creates a clearance so that the proximal end of the forward conveyor 16 can be moved downward below the level of the storage conveyor 30. After that, the cylinder 44 is again actuated to move the storage conveyor 30 back to its forward position, as shown in FIG. 4, so the forward end of the conveyor web 36 overlaps the web 18 of the forward conveyor 16. Then the storage conveyor 30 can be indexed forward so the collected solid waste is transferred onto the forward conveyor, where it is carried forward and upwardly, and can be deposited into a receptacle such as a dumpster D.

The vertical position or height of the proximal end of the forward conveyor can be adjusted between the high position as shown in FIG. 2 and a lower position, as need be. For example if a large heavy article, such as a tree branch or log, is picked up, the operator can lower the back end of the conveyor 16 so that the log can be place gently onto the web 36 of the storage conveyor. The conveyor 16 can be lifted as need be to ensure that the back end stays above the top of the debris that has been piled onto the conveyor 30.

Figure 7:
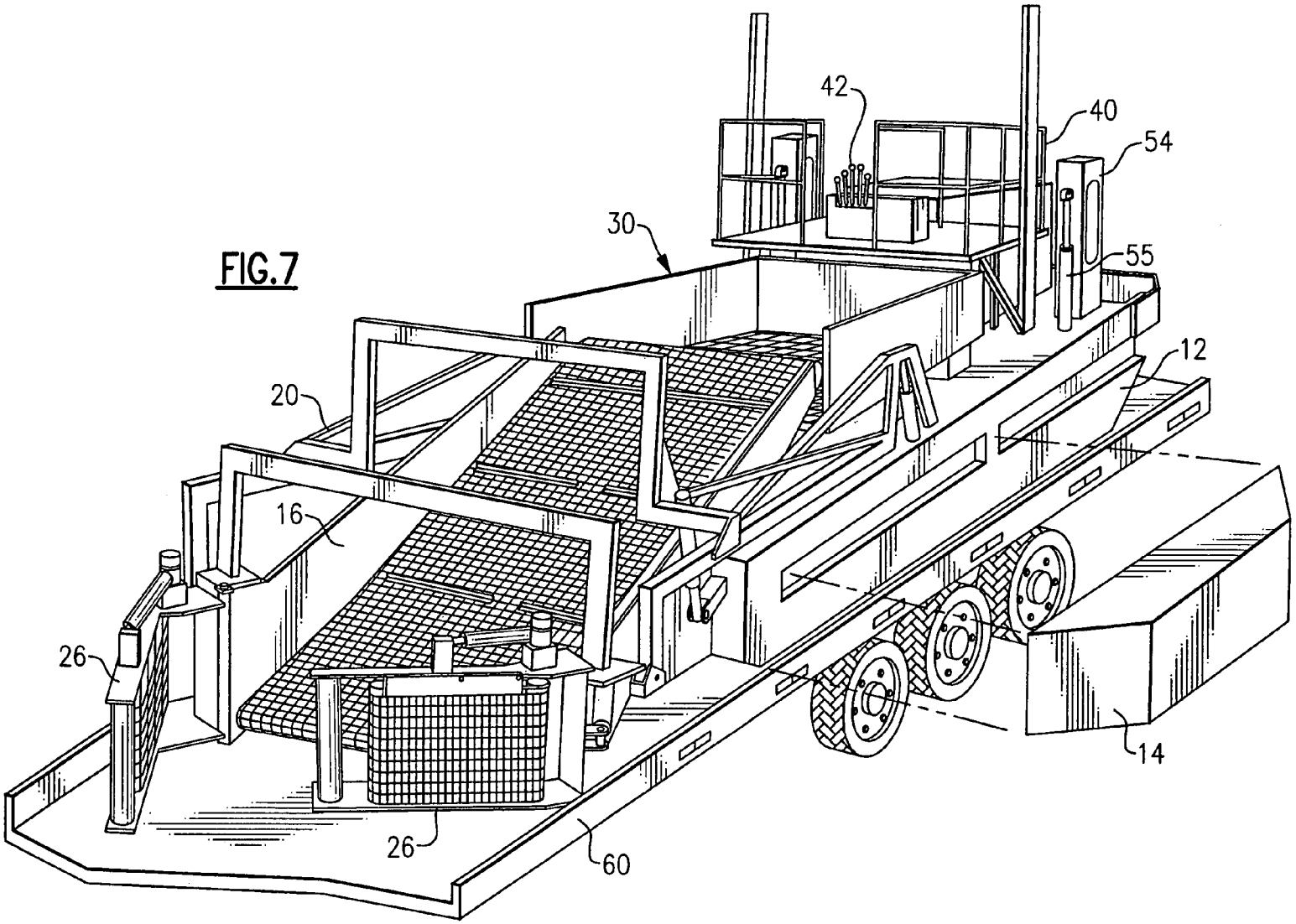
FIG. 7 is a perspective view of the trash skimmer of this embodiment positioned on a trailer for road transport, and featuring the detachable side sponsons or floats that may be removed to meet highway transportation width requirements.

When it is necessary to use road transport to move the trash skimmer boat 10 to another location, the boat can be placed onto a trailer, e.g., trailer 60 as shown in FIG. 7. The auxiliary floats 14 or sponsons are removed from the sides of the hull portions 12. This arrangement allows the boat 10 to be maximum width or beam from port to starboard, and still be legal for road transport when the additional width of the auxiliary floats is removed. The auxiliary floats are generally hollow aluminum members, and are light enough to be handled by one or two person. These are clamped or bolted in place with suitable fasteners (not shown). In the water, the auxiliary floats provide sufficient additional buoyancy or flotation to help support the weight of the front conveyor 16 at the bow end of the boat.

In FIG. 7, the front conveyor is shown lowered, to rest on the deck of the trailer 60.

While hydraulic drive means are employed in this embodiment, mechanical or other power transmission systems could be used for the conveyors and for navigation. The boat 10 may favorably be constructed of metal, e.g., steel or aluminum, for general fresh water use, but other materials may be employed. The slide 38 need not be limited to a linear track, but can be any mechanism that permits the conveyor 30, or at least its forward end, to travel to provide a sufficient clearance, as discussed above. While the trash skimmer boat of this invention has been described in reference to a preferred embodiment, it should be understood that the invention is not limited to that precise embodiment. Rather, many modifications and variations will present themselves to those skilled in the art without departing from the scope and spirit of the invention, as defined in the appended claims.

I claim:

1. A trash collection skimmer boat for collecting trash in a body of water and later discharging the collected trash to a discharge station, the skimmer boat comprising:

a flotation hull that includes one or more floats, the hull having a bow or forward end and a stern or rear end;

a storage conveyor on the hull and having forward and aft ends;

slide means on which the storage conveyor is mounted to the hull permitting the storage conveyor to move fore and aft for a limited distance relative to the hull;

actuator means for controllably moving said storage conveyor in the fore and aft direction over said limited distance;

a forward conveyor for picking up trash from the body of water and for discharging the trash stored on the skimmer boat to said discharge station, including a frame extending past the bow of the trash skimmer, means mounting the frame to the hull, a web, and fore and aft rollers over which the web travels and defining distal and proximal ends of the forward conveyor; and means for controllably orienting the forward conveyor such that in a trash collection position the proximal end of the forward conveyor is positioned above the forward end of the storage conveyor, and in a trash discharge position the proximal end of the forward conveyor is positioned below the forward end of the storage conveyor.

2. The trash collection skimmer boat of claim 1 comprising an engine supplying power to said conveyors and to said actuator, and wherein said engine is mounted on said hull sternward of said storage conveyor and on a centerline of said hull.

3. The trash collection skimmer boat of claim 1 wherein said hull comprises a main hull and also comprises a pair of demountable auxiliary floats mounted outward of said main hull to provide additional floatation when the boat is in the water but which can be removed from the hull to permit the boat to be trailerized.

4. The trash collection skimmer boat of claim 2 wherein said hull comprises a stern hull portion beneath said engine and a pair of pontoon member that extend forward from the stern hull portion.

5. The trash collection skimmer boat of claim 2 comprising a hydraulic drive system including a hydraulic pump sternward of said storage conveyor and powered by said engine, and means connecting said pump with said actuator.

6. The trash collection skimmer boat of claim 5, comprising a pair of screw drives, each positioned at the stern of said hull and at right and left sides thereof, and each having a respective hydraulic motor powering the screw drive and coupled to said hydraulic pump.

7. The trash collection skimmer boat of claim 6, wherein each of said screw drives is mounted on a respective elevator at the stern of the boat to permit the vertical position of the drives to be adjusted so as to control the depth of the screw drives.

8. The trash collection skimmer boat of claim 1, comprising a control deck on which an operator is positioned, the control deck being supported on said hull above the storage conveyor.

9. The trash collection skimmer boat of claim 8, wherein said control deck is centered on a centerline of said boat.

10. The trash collection skimmer boat of claim 1, wherein said storage conveyor includes a web and forward and rear rollers over which said web travels and defining forward and aft ends of said storage conveyor.

11. The trash collection skimmer boat of claim 10, wherein said storage conveyor can be controllably indexed in forward and reverse directions for incrementally moving said web during collection and during discharge.

12. The trash collection skimmer boat of claim 1, wherein said forward conveyor further includes a pair of supplemental conveyors disposed on left and right jaw members, respectively, situated at the distal end of said forward conveyor, with said jaw members being articulated to open and close laterally.

* * * * *